United States Patent [19]

Kokayeff

[11] Patent Number: 4,645,587

[45] Date of Patent: Feb. 24, 1987

[54] PROCESS FOR REMOVING SILICON COMPOUNDS FROM HYDROCARBON STREAMS

[75] Inventor: Peter Kokayeff, Brea, Calif.

[73] Assignee: Union Oil Company of California, Los Angeles, Calif.

[21] Appl. No.: 679,302

[22] Filed: Dec. 7, 1984

[51] Int. Cl.[4] ..... C10G 25/00; C10G 29/04

[52] U.S. Cl. ..... 208/91; 208/89; 208/296; 208/299; 208/302; 208/306; 502/415

[58] Field of Search ..... 208/296, 299, 306, 302, 208/211, 91, 89; 502/415

[56] References Cited

U.S. PATENT DOCUMENTS

| | | | |
|---|---|---|---|
| Re. 29,771 | 9/1978 | Cull et al. | 502/415 |
| 2,761,815 | 9/1956 | Hutchings | 208/296 |
| 2,917,452 | 12/1959 | Brooke et al. | 208/91 |
| 3,700,587 | 10/1972 | Hyde | 208/131 |
| 3,986,844 | 10/1976 | Yates | 44/50 |
| 4,125,457 | 11/1978 | Brennan et al. | 208/299 |
| 4,163,708 | 8/1979 | Jacobson et al. | 208/91 |
| 4,176,047 | 11/1979 | Orrell et al. | 208/51 |
| 4,224,191 | 9/1980 | Bishop, III | 252/463 |
| 4,259,213 | 3/1981 | Bishop, III | 502/415 |
| 4,269,694 | 5/1981 | Holland et al. | 208/48 R |
| 4,343,693 | 8/1982 | Holland et al. | 208/244 |
| 4,344,841 | 8/1982 | Johnson et al. | 208/211 |
| 4,582,819 | 4/1986 | Miller et al. | 502/415 |

FOREIGN PATENT DOCUMENTS

| | | | |
|---|---|---|---|
| 2018282 | 10/1979 | United Kingdom | 208/91 |

*Primary Examiner*—Andrew H. Metz
*Assistant Examiner*—Helane Myers
*Attorney, Agent, or Firm*—Yale S. Finkle; Gregory F. Wirzbicki; Dean Sandford

[57] ABSTRACT

Silicon components are removed from a hydrocarbon stream by contacting the stream with a sorbent comprising a mixture of a copper component and a porous, inorganic refractory oxide containing alumina. Preferably, the porous, inorganic refractory oxide will contain greater than about 10 weight percent alumina and most preferably consists essentially of alumina. It is normally desired to contact the hydrocarbon stream with the sorbent in the presence of molecular hydrogen in order to prevent coking of the sorbent. The sorbent may be a fresh mixture of the copper component and the porous, inorganic refractory oxide or it may be a spent sorbent prepared by using the fresh sorbent to remove sulfur components from a hydrocarbon stream. Alternatively, the sorbent may be a regenerated sorbent prepared by burning carbonaceous residues off a sorbent that was previously used to remove sulfur components from a hydrocarbon stream.

29 Claims, 1 Drawing Figure

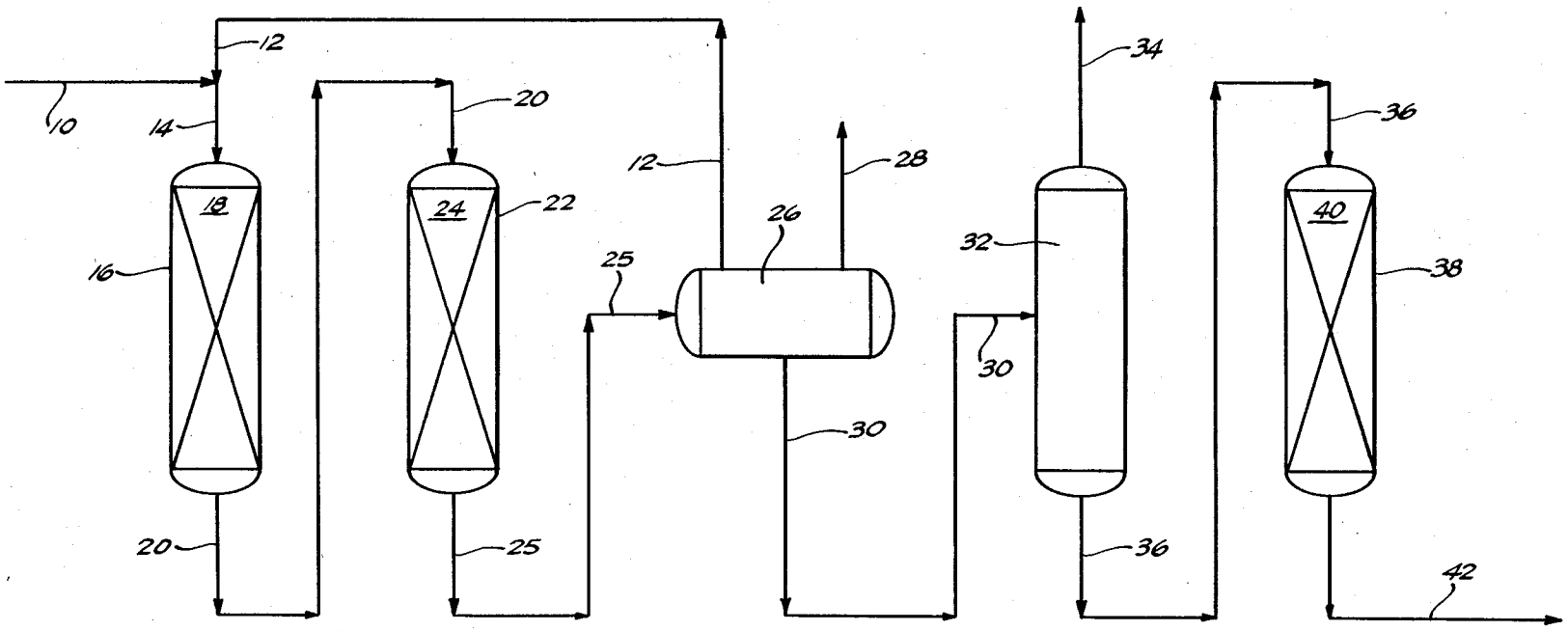
10
12
14
16
18
20
22
24
25
26
28
30
32
34
36
38
40
42

PROCESS FOR REMOVING SILICON COMPOUNDS FROM HYDROCARBON STREAMS

BACKGROUND OF THE INVENTION

This invention relates to a process for removing compounds containing silicon from hydrocarbon streams and is particularly concerned with a process for removing organosilicon compounds from reformer feedstocks to prevent silicon poisoning of the reformer catalyst.

Catalytic reforming is a conventional refining process which is utilized for such purposes as dehydrogenation, hydrogenation, cyclization, dehydrocyclization, isomerization and dehydroisomerization of selected hydrocarbons. Catalytic reforming is normally utilized to upgrade straight run or cracked naphtha feedstocks by increasing the octane number of the feedstock's gasoline fraction. In a typical reforming process in which a straight run or cracked naphtha is upgraded, the feedstock is contacted with a catalyst comprising a noble metal on alumina. The conditions utilized in the reforming process will vary depending upon, among other factors, the type of feed being processed and the desired increase in octane level.

Reforming catalysts, particularly those containing platinum, and most particularly those comprising platinum, rhenium and chlorine, are poisoned or deactivated rapidly in the presence of sulfur components. Thus, to achieve maximum run lengths and increase process efficiency, it is necessary to reduce the sulfur content of reformer feedstocks as low as possible.

One common method of removing sulfur compounds from reformer feedstocks is to subject the feedstock to catalytic hydrodesulfurization by contacting the feedstock with molecular hydrogen in the presence of a sulfur-tolerant hydrotreating catalyst. The sulfur compounds in the hydrocarbon stream are converted to hydrogen sulfide, which may be separated from the hydrocarbon stream by conventional means prior to subjecting it to reforming. Although highly effective sulfur removal may be achieved by catalytic hydrodesulfurization, the efficiency of the process is ultimately limited by equilibrium and/or kinetic considerations. In general, it is not possible to obtain hydrodesulfurized products containing less than about 0.5 ppmw sulfur as is desired in most reforming operations. Furthermore, it is impossible to guard against upsets in the catalytic hydrodesulfurization units which can result in high levels of organosulfur compounds remaining in the reformer feedstock.

In addition to being highly sensitive to sulfur components, reforming catalysts are also poisoned by compounds containing silicon. One common source of hydrocarbon streams containing silicon compounds is the delayed coking unit utilized in many petroleum refineries. Such a unit is used to convert residual oils into more valuable products. The overhead vapors from the coking drum, which is part of the delayed coking unit, are normally fractionated into various cuts including a gasoline boiling range stream commonly referred to as coker gasoline or coker naphtha. This stream generally possesses a low octane number and is therefore unsuitable for use as automotive fuel without upgrading. Thus, it has become common practice to increase the octane number of coker gasoline by subjecting it to catalytic reforming. The coker gasoline will not only contain sulfur compounds but, quite frequently, will contain organosilicon components derived from silicon defoamers, such as polydimethyl siloxanes, added in the delayed coking process to prevent foaming.

In view of the above, it is desirable to remove both sulfur compounds and silicon compounds from coker gasoline and other hydrocarbon streams that are to be processed in catalytic reformers. If a stream containing both sulfur and silicon compounds is subjected to catalytic hydrodesulfurization or hydrotreating, the sulfur will not only be removed by conversion to hydrogen sulfide but the silicon compounds will deposit on the catalyst. It is, however, not desirable to use the hydrotreating catalyst to remove silicon components from reformer feedstreams. After a certain amount of silicon deposits on the catalyst, complete removal of silicon compounds will no longer take place and the effluent from the hydrotreating unit will contain at least trace amounts of organosilicon components which will irreversibly poison the reforming catalyst. Moreover, the deposited organosilicon components will have a deleterious effect on the hydrotrating catalyst, tending to poison it and decrease its effectiveness.

Accordingly, it is one of the objects of the present invention to provide a process for removing silicon components from reformer feedstreams prior to subjecting the feedstreams to catalytic hydrotreating to remove sulfur components. It is another object of the invention to provide a process for removing silicon components from reformer feedstreams which have previously been subjected to catalytic hydrotreating. Altenatively, it is a further object of the invention to provide a process which can be used to simultaneously remove sulfur and silicon components from reformer feedstreams. These and other objects of the invention will become more apparent in view of the following description of the invention.

SUMMARY OF THE INVENTION

In accordance with the invention, it has now been found that silicon components can be removed from a hydrocarbon stream by contacting the stream with a sorbent comprising a copper component and alumina. The sorbent may be fresh, spent, or regenerated. The phrases "fresh sorbent", "spent sorbent", and "regenerated sorbent" as used herein refer respectively to a mixture of a copper component and alumina which has not previously been used to remove sulfur compounds from a hydrocarbon stream, a mixture of a copper component and alumina which has previously been used to remove sulfur compounds from a hydrocarbon stream, and a mixture of a copper component and alumina prepared by burning carbonaceous material off a mixture of a copper component and alumina that has previously been used to remove sulfur compounds from a hydrocarbon stream under conditions such that carbonaceous material deposited on the mixture.

In a preferred embodiment of the invention, a naphtha reformer feed containing organosilicon compounds and organosulfur compounds, such as mercaptans, disulfides and thiophenes, is contacted in a first sorption zone with a spent sorbent comprising a mixture of a copper compound and alumina. The effluent from the first sorption zone is then contacted with a hydrotreating catalyst in a hydrotreating zone to remove organosulfur compounds. The liquid effluent from the hydrotreating zone is contacted in a second sorption zone with a fresh sorbent comprising a mixture of a copper compound and alumina. The effluent from the second sorption zone is passed to a reforming zone for upgrading into a higher octane stream. It has been found that after the sorbent used in the second sorption zone becomes spent with respect to removing sulfur components, it remains active with respect to removing silicon components. Thus, it is preferred to use the spent sorbent from the second sorption zone as an inexpensive source of the sorbent utilized in the first zone.

BRIEF DESCRIPTION OF THE DRAWING

The drawing is a schematic flow diagram of a process for removing silicon compounds from a hydrocarbon stream carried out in accordance with the invention.

DETAILED DESCRIPTION OF THE INVENTION

The process of the invention may be used to treat any vaporous or liquid hydrocarbon stream containing silicon compounds, normally organosilicon compounds. Examples of hydrocarbon streams that may be treated in the process of the invention include coker naphtha, virgin naphtha, cracked naphtha, kerosene, distillate fuels and gas oils. Typically, the source of the silicon compounds will comprise antifoam agents used to prevent foaming in delayed coking processes. Examples of silicon compounds that can be removed in the process of the invention include polysiloxane antifoam agents, silanes, and silanols. Normally, the hydrocarbon stream will be a catalytic reformer feedstream containing silicon in a concentration ranging between about 0.01 and about 25 ppmw, typically between about 5 ppmw and about 15 ppmw.

The sorbent with which the silicon-containing hydrocarbon stream is contacted is a mixture of a copper component and a porous, inorganic refractory oxide component containing alumina. The refractory oxide component will normally contain greater than about 10 weight percent alumina, preferably greater than about 60 weight percent, more preferably greater than about 80 weight percent, and most preferably will consist essentially of alumina with only trace amounts of impurities. A silica-alumina combination refractory oxide component may also be used. Normally, such a combination of refractory oxide components will contain between about 10 and about 40 weight percent silica and between about 60 and about 90 weight percent alumina. In general, the porous, inorganic refractory oxide component will have a surface area between about 50 and about 800 square meters per gram.

The copper component utilized as part of the fresh sorbent will normally be copper oxide or a copper compound which is converted to copper oxide at high temperatures. The primary purpose for the presence of the copper component is to allow the fresh sorbent to be used for removing sulfur components from a hydrocarbon stream either simultaneously with silicon components or prior to using the sorbent to remove silicon components. It is believed that the copper component in the spent sorbent is in the form of copper sulfide produced by reaction of the copper component in the fresh sorbent with sulfur constituents in the hydrocarbon stream treated with the fresh sorbent. The copper component in the regenerated sorbent is believed to be in the form of copper sulfate produced by the reaction of copper sulfide with oxygen when carbonaceous material is burned off the spent sorbent. In general, the fresh, spent, or regenerated sorbent will contain between about 5 weight percent and about 40 weight percent copper, calculated as the metal, preferably between about 15 weight percent and about 30 weight percent.

The fresh sorbent is normally prepared by combining the copper component with the porous, inorganic refractory oxide component by comulling or by aqueous impregnation if the copper compound is soluble in water. Copper carbonate is the preferred copper compound when the fresh sorbent is produced by comulling. When the fresh sorbent is prepared by impregnation, copper nitrate is preferred. If the sorbent is prepared by comulling, the copper component is mulled with the refractory oxide component to form a paste which is then extruded through a die to produce extrudates having a circular cross sectional diameter from about 1/20 to about $\frac{1}{4}$ of an inch, preferably about $\frac{1}{8}$ of an inch. These extrudates are then heated to a temperature between about 500° F. and about 1000° F. to produce the sorbent. Upon heating at these high temperatures, the copper component is normally converted to copper oxide. If the fresh sorbent is prepared by impregnation, the refractory oxide component is first extruded into the desired size particles and calcined, following which these particles are impregnated with an aqueous solution of the copper compound, preferably copper nitrate, dried and then heated to temperatures sufficiently high to convert the copper nitrate to copper oxide.

The temperatures and pressures at which the sorbent is contacted with the hydrocarbon stream containing silicon components may vary widely and will normally depend upon the type of unit to which the hydrocarbon stream serves as feedstock. The temperatures may range broadly between about 200° F. and about 900° F. while the pressure may vary from atmospheric to about 1000 p.s.i.g. If the hydrocarbon stream is being utilized as direct feedstock to a catalytic reformer, the temperature in the sorption zone will normally range between about 250° F. and about 450° F. and the pressure will vary from about 150 p.s.i.g. to about 600 p.s.i.g. If, on the other hand, it is desired to remove silicon components from the feed to a hydrotreating unit, the sorption temperature will typically range between about 450° F. and about 800° F. while the pressure varies from about 200 p.s.i.g. to about 500 p.s.i.g. If the temperature in the sorption zone is greater than about 450° F., it is usually desirable that molecular hydrogen be present in order to prevent deactivation of the sorbent by coking. The hydrogen will serve to hydrogenate coke precursors and thereby inhibit coke from laying down on the surface of the sorbent.

The fresh sorbent is active for removing sulfur components and may therefore be used to treat hydrocarbon feedstreams containing both sulfur and silicon components. It has been found that when silicon components are present in a feedstream in conjunction with sulfur components, the capacity of the sorbent to remove sulfur components is not greatly affected by the simultaneous removal of the silicon components. It has been further found that when the fresh sorbent is contacted with a feedstream containing sulfur components but no silicon components and becomes spent with respect to removing the sulfur components, the spent sorbent is still active for removing silicon components. This discovery has led to the beneficial use of spent sulfur sorbents comprising a copper component and a refractory oxide component containing alumina, which would otherwise have to be discarded, for removing silicon compounds from hydrocarbon streams. It has also been found that a sorbent which is spent with respect to removing sulfur compounds from hydrocarbon streams can be made even more active for removing silicon compounds by subjecting the spent sorbent to an oxidative treatment to remove carbonaceous residues and thereby produce a regenerated sorbent.

The drawing illustrates a specific embodiment of the process of the invention in which both a fresh and spent sorbent are used to remove silicon compounds from hydrocarbon streams. In this embodiment of the invention, a naphtha stream containing both organosilicon and organosulfur compounds and produced by fractionating the overhead from the coking drum of a delayed coking process in which silicon-containing antifoam agents are utilized is passed from a storage facility not shown in the drawing into line 10 where it is mixed with a gas containing molecular hydrogen introduced through line 12. The resultant mixture is then passed through line 14 into silicon sorption vessel 16 wherein the mixture is passed through first sorption zone 18 in contact with a spent sorbent comprising a mixture of a copper component and alumina which mixture had been previously used to remove sulfur components from a hydrocarbon stream as described in more detail hereinafter. The temperature in the first sorption zone will normally range from about 450° F. to about 800° F. The pressure will be between about 200 p.s.i.g and about 500 p.s.i.g. The liquid hourly space velocity will typically be in the range between about 2.0 and about 40, preferably between about 2.0 and about 8.0. Sufficient gas is introduced into the naphtha stream through line 12 so that hydrogen is present in the first sorption zone in a concentration ranging between about 250 and about 1500 standard cubic feet per barrel of feed.

As the naphtha vapors pass through the first sorption zone, silicon compounds are removed from the naphtha stream. It is not presently understood exactly how the removal occurs. It is, however, theorized that the silicon compounds bond to the alumina. It has been surprisingly found that the presence of the copper component and sorbed sulfur compounds do not interfere with removal of the silicon compounds. Normally, the naphtha feedstream will contain silicon in any amount ranging up to about 25 ppmw. The spent sorbent present in first sorption zone 18 will remove substantially all of the silicon compounds from the naphtha stream. The effluent from silicon sorption vessel 16 will be substantially free of silicon contaminants but will contain sulfur contaminants.

The majority of the sulfur components present in the effluent from silicon sorption vessel 16 are removed by passing the effluent through line 20 into hydrotreater 22 wherein the effluent is passed through hydrotreating zone 24 in contact with a hydrotreating catalyst. The temperature in the hydrotreating zone will normally range between about 450° F. and about 800° F., preferably between about 600° F. and about 700° F. The hydrotreating pressure will range from about 150 p.s.i.g. to about 800 p.s.i.g., preferably from about 200 p.s.i.g. to about 500 p.s.i.g. The liquid hourly space velocity will typically be in the range between about 0.1 and about 15, preferably between about 2.0 and about 7.0. Under such conditions, molecular hydrogen in the effluent from silicon sorption vessel 16 will react with sulfur and nitrogen components in the effluent to produce hydrogen sulfide and ammonia, respectively.

The catalyst utilized in the hydrotreating zone will normally be composed of a Group VIII hydrogenation metal component in combination with a Group VIB hydrogenation metal component supported on an amorphous, porous, inorganic refractory oxide support such as alumina. In some cases phosphorus or other acid component may also be present in the combination. A preferred hydrotreating catalyst comprises a sulfided, particulate composition comprising a nickel or cobalt component, a molybdenum or tungsten component, and a phosphorus component on a support consisting essentially of alumina or alumina in combination with small amounts of silica. The catalyst is generally employed as a bed of particulates through which the feedstock and molecular hydrogen are passed downwardly under appropriate conditions so as to convert the organonitrogen components in the feedstock to ammonia and the organosulfur components to hydrogen sulfide.

The effluent from hydrotreater 22 is cooled in a heat exchanger, which is not shown in the drawing, to between about 80° F. and about 200° F. and passed through line 25 to vapor-liquid separator 26, which is maintained at about the same pressure as exists in hydrotreater 22. Here a hydrogen rich gas is separated from the hydrocarbon liquid in the cooled effluent and recycled via lines 12 and 14 to silicon sorption vessel 16. To prevent ammonia and hydrogen sulfide from accumulating within the system, a small bleed stream of gas is removed from separator 26 through line 28. The hydrocarbon liquid from which the gas has been separated is withdrawn from separator 26 through line 30 and passed to stripper 32 where hydrogen sulfide, ammonia and water dissolved in the hydrocarbon liquid are removed overhead through line 34. The stripper is typically operated at a temperature between about 150° F. and about 500° F. and a pressure approximately equivalent to that in separator 26.

The bottoms exiting stripper 32 through line 36 will comprise a hydrocarbon liquid substantially free of hydrogen sulfide, ammonia, water and silicon compounds. The bottoms stream, however, may contain a small amount of sulfur compounds. Although the concentration of sulfur in this stream may be very small, less than about 1.0 ppmw, it is desirable to remove the residual sulfur components since the ultimate destination of the hydrocarbon stream is a reformer containing a reforming catalyst that is highly sensitive to any amount of sulfur. Furthermore, upsets in the operation of hydrotreater 22 may periodically result in relatively high concentrations of sulfur in the bottoms from stripper 32. In light of this, the stripper bottoms is normally subjected to further treatment to remove substantially all sulfur components prior to its passage to the catalytic reformer.

In order to remove essentially all the sulfur in the bottoms stream from stripper 32, the stream is passed through line 36 into sulfur sorption vessel 38. Here the bottoms stream is contacted in second sorption zone 40 with a fresh sorbent comprising a copper component in intimate mixture with alumina. As the bottoms stream passes through the second sorption zone, the sulfur components are removed from the bottoms by reaction with the copper component in the sorbent. The temperature in the second sorption zone will normally range from about 250° F. to about 450° F., preferably from about 300° F. to about 400° F. The pressure in the second sorption zone will typically be between about 150 p.s.i.g. and about 600 p.s.i.g. The presence of molecular hydrogen is normally not required to prevent coking of the sorbent under the above temperature and pressure conditions. The effluent exiting sulfur sorption vessel 38 in line 42 is substantially free of sulfur and silicon components and is therefore ready to be fed directly to a catalytic reformer, not shown in the drawing, for upgrading to higher octane components.

Once the sorbent in sulfur sorption vessel 38 has become spent with respect to sulfur removal, i.e., it can no longer remove sulfur from the stripper bottoms stream in line 36, it must be removed from vessel 38. The sorbent cannot be regenerated for reuse as a sulfur sorbent and is normally discarded. It has now, however, been surprisingly found that this spent sorbent is active for removing silicon compounds from hydrocarbon streams. Thus, instead of disposing of the spent sorbent at a considerable expense, it is utilized in the process of the invention as the silicon sorbent in sorption vessel 16. It has also been found that the fresh sorbent in reactor 38 will remove silicon components from hydrocarbon streams simultaneously with sulfur components. Thus, the sorbent in sulfur sorption vessel 38 will also protect the reforming catalyst from silicon components that may be present in the effluent from stripper 32.

In the embodiment of the invention shown in the drawing and described above, a sorbent comprising a mixture of a copper component and a porous, inorganic refractory oxide containing alumina is used in sulfur sorption vessel 16 to remove silicon components from a hydrocarbon stream and is also used in sorption vessel 38 to remove sulfur components from a hydrocarbon stream. The sorbent used in vessel 38 is fresh, i.e., it has not been previously used to remove either silicon or sulfur components. The sorbent used in silicon sorption vessel 16, on the other hand, is a spent sorbent that was previously used in vessel 38 to remove sulfur components before it was placed in vessel 16. As previously pointed out, the fresh sorbent simultaneously removes silicon and sulfur components from hydrocarbon streams. Thus, in an alternative embodiment of the process of the invention, silicon sorption vessel 16 is removed from the process flow scheme shown in the drawing and sulfur sorption vessel 38 is used to remove both silicon and sulfur components from the feed to the catalytic reformer. The disadvantage of operating pursuant to this flow scheme is that silicon compounds will build up in hydrotreating zone 24 and will have a deleterious effect on the activity of the hydrotreating catalyst. It is therefore preferable to remove silicon compounds from the hydrocarbon feed prior to subjecting the feed to hydrotreating.

It has been found that if the spent sorbent from sulfur sorption vessel 38 is subjected to an oxidative treatment with air to remove carbonaceous residues and convert sorbed sulfur to the sulfate form, the resultant regenerated sorbent, like the spent sorbent, will be active for removing silicon compounds from hydrocarbon streams. In fact, it has been found that such a regenerated sorbent is more active than pure alumina for removing silicon compounds. Thus, it may be desirable in some instances to subject the spent sorbent from vessel 38 to an oxidative treatment prior to using the sorbent in silicon sorption vessel 16.

The nature and objects of the invention are further illustrated by the following examples, which are provided for illustrative purposes only and not to limit the invention as defined by the claims. Example 1 illustrates that a sorbent comprising a mixture of a copper component and a porous, inorganic refractory oxide component containing alumina will simultaneously remove sulfur and silicon compounds from hydrocarbon streams. Example 2 illustrates that such a copper-alumina sorbent that has previously been used to remove sulfur compounds from hydrocarbon streams is an effective sorbent for removing silicon compounds from hydrocarbon streams. Example 3 demonstrates that when the sorbent of Example 2 is subjected to an oxidative treatment to remove carbonaceous residues, it becomes a more effective sorbent for removing silicon compounds from hydrocarbon streams.

EXAMPLE 1

Two hundred milliliters of a sorbent comprising a mixture of copper oxide and gamma-alumina is placed in an upright tubular reactor. The sorbent contains 17 weight percent copper, calculated as CuO, and is prepared by mulling copper carbonate with boehmite alumina, extruding the mulled mixture and calcining the resultant extrudates at about 700° F. The reactor is a 69 inch long stainless steel tube having an inside diameter of 1.125 inches. The reactor containing the sorbent is immersed in a salt bath, purged with nitrogen, pressurized to 500 p.s.i.g. and heated to 300° F. Iso-octane containing butanethiol in sufficient quantities such that 213 ppmw sulfur is present is then fed to the reactor at a liquid hourly space velocity of 5.0. The reactor effluent is sampled every 4 hours and analyzed for its sulfur content. After about 120 hours, the amount of sulfur in the effluent is about 95 percent of the amount of sulfur in the feed. At this point in time, the run is terminated and the sorbent is removed from the reactor in three sections of approximately equal volume representing the top, middle and bottom of the sorbent bed and each section is analyzed for sulfur and carbon content. The results of these analyses are set forth in Table 1 below. To investigate the effect of silicon sorption on sulfur sorption, the experiment is repeated as described above except that the iso-octane feed in addition to containing butanethiol also contains Dow Corning 344 Fluid, a polydimethyl cyclosiloxane tetramer, in a sufficient amount such that the feed contains 114 ppmw silicon. The reactor effluent is sampled every 4 hours and analyzed for sulfur and silicon content. For the first 40 hours of the run, more than 90 weight percent of the silicon in the feed is removed. After about 120 hours, the amount of silicon in the effluent is about 90 percent of the amount of silicon in the feed. At this point in time, the run is terminated and the sorbent is removed from the reactor in three sections of approximately equal volume and each section is analyzed for carbon, sulfur, and silicon. The results of these analyses are set forth in Table 1 below and compared to the analyses for the run in which no silicon was present in the iso-octane feed.

TABLE 1

| | Feed Without Silicon | | |
|---|---|---|---|
| Bed Section | Weight % Carbon | | Weight % Sulfur |
| Top | 2.6 | | 3.9 |
| Middle | 2.7 | | 3.6 |
| Bottom | 2.6 | | 3.3 |
| | Feed With Silicon | | |
| Bed Section | Wt. % Carbon | Wt. % Sulfur | Wt. % Silicon |
| Top | 2.9 | 3.5 | 1.9 |
| Middle | 3.0 | 3.1 | 1.7 |
| Bottom | 3.0 | 2.9 | 1.4 |

As can be seen from the data in Table 1, the presence of silicon in the feed has only a minor negative effect on the amount of sulfur removed by the sorbent. The presence of the silicon results in only about a 10 to 15 percent decrease in the amount of sulfur present in the 3 bed sections. Thus, the sulfur capacity of the sorbent remains acceptably high. The data for silicon removal indicate that the silicon is very uniformly sorbed throughout the bed. The capacity of the sorbent with respect to silicon is not as great as with respect to sulfur at the temperature and pressure conditions utilized. These conditions are similar to those that would exist if the sorbent were being used to treat a reformer feedstream. Thus it appears that the sorbent will protect the reformer catalyst from sulfur deactivation while offering at least some protection from silicon deactivation.

EXAMPLE 2

In this series of tests, 80 ml. of a spent sorbent prepared as described in Example 1 and which had been previously used to remove sulfur from a hydrocarbon stream is placed in the reactor tube described in Example 1. This sorbent contains on the average 3.2 weight percent sulfur and 3.2 weight percent carbon. The reactor is placed in a salt bath, purged with nitrogen, then purged with hydrogen, pressurized to 500 p.s.i.g. with hydrogen and heated to 600° F. A mixture of hydrogen and naphtha boiling in the range between 150° F. and 370° F. is then introduced into the reactor such that the liquid hourly space velocity of the naphtha is 5.0. The hydrogen-to-oil ratio is 1500 standard cubic feet per barrel. A sufficient amount of Dow Corning 344 Fluid, a polydimethyl cyclosiloxane tetramer, is injected into the naphtha feed line to the reactor such that the naphtha contains 37 ppmw silicon. The liquid product from the reactor is sampled every 6 hours and analyzed for silicon by emission spectroscopy. No silicon is found in the reactor effluent until after 100 hours have elapsed. After 250 hours on stream, the silicon concentration in the feed stream is increased to 74 ppmw silicon and the run is terminated after 360 hours. The sorbent is then removed from the reactor in three sections of approximately equal volume representing the top, middle and bottom of the sorbent bed. Each section is then analyzed for silicon content. The above described experiment is then repeated using gamma-alumina as the sorbent instead of a spent sorbent comprising a copper component and gamma-alumina. At the end of the run, the gamma-alumina sorbent is removed from the reactor in three sections of approximately equal volume and each section is analyzed for silicon content. The results of the two series of tests are set forth below in Table 2.

TABLE 2

| Silicon Content (Weight % Carbon Free Basis) | | | |
|---|---|---|---|
| Bed Section | Gamma-Alumina | Spent Sorbent | Regenerated Spent Sorbent |
| Top | 7.6 | 8.2 | 9.0 |
| Middle | 7.7 | 7.7 | 8.8 |
| Bottom | 7.6 | 7.5 | 8.3 |

As can be seen from the data in Table 2, the spent sorbent, which not only contains a copper component in combination with gamma-alumina but also sulfur and carbon, is as effective for removing silicon from the naphtha stream as is pure gamma-alumina. This is a somewhat surprising result since it would be expected that the presence of other substances, such as copper, sulfur and carbon, would interfere with the sorptive capacity of the gamma-alumina itself.

EXAMPLE 3

This series of tests is conducted in the same manner as discussed in relation to the series of tests described in Example 2 except that the spent sorbent charged to the reactor is regenerated in situ by an oxidative treatment prior to introducing hydrogen and naphtha into the reactor. After the spent sorbent is placed in the reactor, the reactor is pressurized to 50 p.s.i.g. and nitrogen containing 5 volume percent oxygen is passed through the reactor at a gas hourly space velocity of 3540. The reactor is heated to 600° F. in increments of 100° per hour and held at 600° F. for 4 hours. During the next hour the reactor is gradually heated to 700° F. where it is held for another 4 hours. The reactor is then heated to 800° F. and held at this temperature for 8 hours. The oxygen concentration in the nitrogen gas is then increased to 10 volume percent and the temperature is maintained at 800° F. for another 4 hours. Next, the reactor is purged with pure nitrogen and cooled to 600° F. at which time the flow of nitrogen is terminated and the naphtha feed is introduced into the reactor. The remainder of the run is carried out in an identical manner to that described in Example 2. At the end of the run the sorbent is removed from the reactor in three sections of approximately equal volume representing the top, middle and bottom of the sorbent bed. These sections are analyzed for silicon content and the results are set forth in Table 2 where they are compared to the results obtained in Example 2 using gamma-alumina and a spent sorbent. As can be seen from the data, the regenerated spent sorbent is more effective in removing silicon than both the pure gamma-alumina and the spent sorbent.

Although this invention has been primarily described in conjunction with examples and by reference to several embodiments of the invention, including a preferred embodiment, it is evident that many alterations, modifications and variations will be apparent to those skilled in the art in light of the foregoing description. Accordingly, it is intended to embrace within the invention all such alternatives, modifications and variations that fall within the spirit and scope of the appended claims.

I claim:

1. A process for removing silicon components from a hydrocarbon stream which comprises contacting said stream in the vapor phase in a sorption zone with a sorbent comprising a copper component and alumina in the presence of added molecular hydrogen at a temperature greater than about 450° F. to produce an effluent depleted in silicon components.

2. A process as defined by claim 1 wherein said sorption zone is maintained at a temperature between about 450° F. and about 800° F.

3. A process as defined by claim 1 wherein said hydrocarbon stream comprises the feedstream to a reformer.

4. A process as defined by claim 1 wherein said hydrocarbon stream contains between about 0.01 and about 25 ppmw silicon.

5. A process as defined by claim 1 wherein said silicon components comprise polysiloxane antifoam agents.

6. A process as defined by claim 1 wherein said sorbent comprises a mixture of copper oxide and a porous, inorganic refractory oxide component containing greater than about 80 weight percent alumina.

7. A process as defined by claim 1 wherein said sorbent comprises a mixture of copper oxide and a porous, inorganic refractory oxide component consisting essentially of alumina.

8. A process as defined by claim 1 wherein said sorbent contains between about 5 weight percent and about 40 weight percent copper.

9. A process as defined by claim 1 wherein said sorbent was previously used to remove sulfur components from a hydrocarbon stream.

10. A process as defined by claim 1 wherein said sorbent is prepared by burning carbonaceous residues off a mixture of a copper component and a porous, inorganic refractory oxide component containing alumina, said mixture having previously been used to remove sulfur components from a hydrocarbon stream under such conditions that said carbonaceous residues deposited on said mixture.

11. A process as defined by claim 1 wherein said sorbent has not previously been used to remove sulfur components from a hydrocarbon stream.

12. A process as defined by claim 11 wherein said sorbent is prepared by comulling a copper component with a porous, inorganic refractory oxide component containing alumina, extruding the mulled mixture and calcining the resultant extrudates at a temperature between about 500° F. and about 1000° F.

13. A process as defined by claim 12 wherein said copper component comprises copper carbonate and said porous, inorganic refractory oxide component comprises boehmite alumina.

14. A process as defined by claim 11 wherein said sorbent is prepared by impregnating extrudates of a porous, inorganic refractory oxide component containing alumina with an aqueous solution of a copper component.

15. A process as defined by claim 14 wherein said porous, inorganic refractory oxide component consists essentially of alumina and said copper component comprises copper nitrate.

16. A process as defined by claim 9 wherein said hydrocarbon stream comprises the feedstream to a hydrotreater located upstream of a reformer.

17. A process as defined by claim 10 wherein said hydrocarbon stream comprises the feedstream to a hydrotreater located upstream of a reformer.

18. A process for removing silicon components from a naphtha stream prior to subjecting said stream to catalytic reforming which comprises:

(a) contacting said naphta stream in the vapor phase in a first sorption zone with a sorbent comprising a mixture of a copper component and alumina in the presence of added molecular hydrogen at a temperature greater than about 450° F. to produce an effluent depleted in silicon components, said sorbent having previously been used to remove sulfur components from a hydrocarbon stream in the substantial absence of added molecular hydrogen;

(b) contacting the effluent from said first sorption zone with molecular hydrogen in a hydrotreating zone under hydrotreating conditions in the presence of a hydrotreating catalyst comprising a Group VIB metal component and a Group VIII metal component such that a substantial proportion of the organonitrogen and/or organosulfur components in said effluent are converted to ammonia and/or hydrogen sulfide and a liquid effluent depleted in sulfur components is produced;

(c) contacting the liquid effluent from said hydrotreating zone in a second sorption zone in the substantial absence of added molecular hydrogen with a sorbent comprising a mixture of a copper component and alumina; and (d) withdrawing a naphtha effluent substantially free of sulfur and silicon components from said second sorption zone.

19. A process for removing silicon components from a hydrocarbon stream which comprises contacting said stream in a sorption zone with a sorbent selected from the group consisting of (1) a fresh sorbent comprising a mixture of a copper component and alumina which mixture has not previously been used to remove sulfur compounds from a hydrocarbon stream and (2) a regenerated sorbent prepared by burning carbonaceous material off a mixture of a copper component and alumina that has previously been used to remove sulfur components from a hydrocarbon stream under conditions such that carbonaceous material deposited on said mixture.

20. A process as defined by claim 19 wherein said hydrocarbon stream contains between about 0.01 and about 25 ppmw silicon.

21. A process as defined by claim 19 wherein said fresh sorbent and said regenerated sorbent comprise a mixture of a copper component and a porous, inorganic refractory oxide component consisting essentially of alumina.

22. A process as defined by claim 19 wherein said hydrocarbon stream is contacted with said sorbent at a temperature between about 450° F. and about 800° F.

23. A process for removing silicon components from a hydrocarbon stream prior to subjecting said stream to catalytic reforming which comprises:

(a) contacting said hydrocarbon stream in a first sorption zone with a sorbent comprising a mixture of a copper component and alumina in the presence of added molecular hydrogen at a temperature greater than about 450° F. to produce an effluent depleted in silicon components, said sorbent having previously been used to remove sulfur components from a hydrocarbon stream;

(b) contacting the effluent from said first sorption zone with molecular hydrogen in a hydrotreating zone under hydrotreating conditions in the presence of a hydrotreating catalyst comprising a Group VIB metal component and a Group VIII metal component such that a substantial proportion of the organonitrogen and/or organosulfur components in said effluent are converted to ammonia and/or hydrogen sulfide and a liquid effluent depleted in sulfur components is produced;

(c) contacting the liquid effluent from said hydrotreating zone in a second sorption zone with a sorbent comprising a mixture of a copper component and alumina; and (d) withdrawing a hydrocarbon effluent substantially free of sulfur and silicon components from said second sorption zone.

24. A process as defined by claim 23 wherein said sorbent in said first sorption zone comprises the sorbent previously used in said second sorption zone.

25. A process as defined by claim 23 wherein the liquid effluent from said hydrotreating zone is subjected to stripping to remove hydrogen sulfide and ammonia prior to contacting said liquid effluent with the sorbent in said second sorption zone.

26. A process as defined by claim 23 wherein the sorbent in said first sorption zone is prepared by burning carbonaceous residues off the sorbent previously used in said second sorption zone.

27. A process as defined by claim 23 wherein the temperature in said first sorption zone ranges between about 450° F. and about 800° F. and the temperature in said second sorption zone ranges between about 200° F. and about 450° F.

28. A process as defined by claim 23 wherein said sorbent in said first and second sorption zones comprises a mixture of a copper component and a porous, inorganic refractory oxide component containing greater than about 60 weight percent alumina.

29. A process as defined by claim 28 wherein said porous, inorganic refractory oxide component consists essentially of alumina.

* * * * *